United States Patent [19]

Schmitt et al.

[11] 4,308,091

[45] Dec. 29, 1981

[54] ETCHING MEDIUM AND PROCESS FOR THE CORRECTION OF CHROMED GRAVURE CYLINDERS

[75] Inventors: Dieter Schmitt; Wilhelm Bäumer, both of Darmstadt, Fed. Rep. of Germany

[73] Assignee: Merck Patent Gesellschaft mit beschrankter Haftung, Darmstadt, Fed. Rep. of Germany

[21] Appl. No.: 180,059

[22] Filed: Aug. 20, 1980

[30] Foreign Application Priority Data

Aug. 20, 1979 [DE] Fed. Rep. of Germany ..... 2933686

[51] Int. Cl.[3] ..... C23F 1/02

[52] U.S. Cl. ..... 156/659.1; 156/660; 156/656; 156/664; 156/905; 252/79.2; 252/79.4

[58] Field of Search ..... 252/79.2, 79.4, 142; 156/659.1, 660, 664, 656, 905; 430/300, 302, 307, 310

[56] References Cited

U.S. PATENT DOCUMENTS 2,687,345 8/1954 Murray ..... 252/79.2

*Primary Examiner*—William A. Powell

*Attorney, Agent, or Firm*—Millen & White

[57] ABSTRACT

An etching medium for chromed surfaces, comprises amounts of aluminum chloride, hydrochloric acid and an inorganic reducing agent, effective for etching a chromed surface. This medium is particularly advantageous when used for the correction of chromed gravure cylinders.

8 Claims, No Drawings

ETCHING MEDIUM AND PROCESS FOR THE CORRECTION OF CHROMED GRAVURE CYLINDERS

BACKGROUND OF THE INVENTION

When producing gravure cylinders, the image originals are transferred to a copper cylinder by conventional methods. Small wells, which are separated by lands, are produced on the copper cylinder either by engraving or by etching. If a part of an image is to appear dark, the cylinder has a very large number of large and deep wells in this area. If a part of the image is to appear light, the wells are correspondingly small and shallow.

In practice, the transfer of the image impression to the cylinder, in the form of small and large wells is never so accurate that, upon printing, the resultant image actually corresponds to the desired original. It is, therefore, necessary to subsequently enlarge or reduce the size of these wells by an appropriate amount. If a color at one location appars too light, the wells in this region of the cylinder must be so enlarged that more printing ink is taken up by the well and can be transferred to the image.

In this correction process, the lands are protected by a so-called hard etching ink. This hard etching ink is a black paste which is rolled, using a roller, in a very thin layer onto the lands in the image area to be corrected. When the cylinder surface consists of copper, the copper will be dissolved in the well upon etching with an iron-III salt solution, and, as a result, the well will be enlarged.

However, gravure cylinders for large printing runs must be chromed. After chroming, a sample print must then be run with the chromed cylinder. If it is found during this run that the depth of color in some image areas appears too light, the hard etching ink is rolled onto the lands of the chromed cylinder in those particular image areas, in the manner described above; image areas which are not to be corrected are masked with an asphalt varnish. After these protective measures, the cylinder is treated with an etching solution which dissolves the chromium coating in a controllable manner, so that the volume of the wells is enlarged.

In this etching process, it is very important that the etching solution uniformly wets the part of the image to be corrected. If only partial wetting takes place, this image area will be unevenly etched and spots and streaks will appear in the finally printed image. The demand made of a good etching medium is, therefore, that it uniformly wet the zones to be corrected and start the etching process at a uniform rate. It is also extremely important that the etching medium not attack the hard etching ink protecting the lands. Otherwise, etching of the lands will also start and, as a result, during the printing process there will be an overflow and damage to the cylinder.

A disadvantageous characteristic of the currently commercially available etching solutions for chromium coatings, and which contain zinc chloride as the active substance, is that they effect relatively poor wetting of the lands which have been rolled and protected with hard etching ink. This is particularly pronounced in image areas which contain very small wells and very broad lands. In these areas, a very high proportion of the surface is covered with hard etching ink, which is water-repellent. However, it is precisely these areas which must be wetted particularly well by the etching solution if the formation of spots and streaks in the printed image is to be avoided. On the other hand, however, it must be ensured that the etching medium does not attack the lands protected with hard etching ink. Specifically, if the hard etching ink is wetted well, there is, at the same time, a danger that the chromium coating of the lands located beneath the ink will also be attacked. Thus, apparently contradictory demands are made of the etching solutions.

A further disadvantage of the etching media used hitherto is due to the zinc chloride contained therein. This is because, for reasons of environmental protection, the zinc must be removed as completely as possible from the exhausted etching medium before the latter passes into the effluent. For this purpose, the exhausted etching medium solution is usually treated with sodium hydroxide solution, which results in the formation of sparingly soluble zinc hydroxide. However, it has been found in practice that accurate metering of the sodium hydroxide solution presents very great difficulties. If too small an amount of sodium hydroxide solution is metered into the exhausted etching solution containing zinc ions, too much zinc will remain in solution. If, on the other hand, too large an amount of sodium hydroxide solution is metered in, the zinc hydroxide already precipitated redissolves to produce the zincate, which thus, passes into the effluent. For this reason, it has not proved possible in practice to reduce the zinc content to below the maximum value of about 2 mg of zinc per liter, demanded for effluents.

SUMMARY OF THE INVENTION

Accordingly, it is an object of this invention to provide an etching medium which wets the chromed gravure cylinders uniformly and enables a simpler effluent treatment to be used.

Upon further study of the specification and appended claims, further objects and advantages of this invention will become apparent to those skilled in the art.

It has now been found that it is possible to prepare such an etching medium based on aluminum chloride.

These objects have thus been attained by this invention by providing an etching medium for chromed surfaces, comprising an aqueous metal chloride solution containing hydrochloric acid, wherein aluminum chloride is the metal chloride and additionally comprising an inorganic reducing agent, an additive which regulates the viscosity and n-propanol or isopropanol.

This invention further relates in another aspect, to a process for the correction of chromed gravure cylinders using an etching medium of this type.

DETAILED DESCRIPTION

It has been found, surprisingly, that when chromed cylinders are corrected using the etching medium of this invention, the areas with small wells and broad lands, which are protected by hard etching ink, are wetted particularly well. Nevertheless, the hard etching ink on the lands does not even start to dissolve, so that the lands are not attacked by the etching medium of this invention. Furthermore, the etching medium of this invention is distinguished by enabling extremely uniform etching. It is thus possible for the first time to correct image areas which on printing give color shades which are too pale, in such a way that the corresponding wells are all enlarged to a uniform extent. As a result, the occurrence of spots and streaks in the printed image is avoided. Furthermore, the good wetting and the uniform etching ensure that even regions of the cylinder which have large wells and narrow lands can be flawlessly processed. It is precisely these regions with narrow lands which are most endangered by wiping during printing. Using the etching medium of this invention, it is possible, with the resultant corrected cylinders, to achieve printing runs which are substantially larger than those obtained hitherto.

Furthermore, when the etching medium of this invention is used, it is possible to remove the metal ions from the exhausted etching solutions, which pass into the effluent, by neutralization with sodium hydroxide solution in the manner which is in itself customary. The extent of this removal is such that the concentrations of these ions are far below the specified maximum concentrations. In tests carried out under realistic practical conditions, the concentrations of aluminum, nickel, copper and chromium found in the effluent were about 0.1 mg/l in each case when the etching medium of this invention was used; while when the conventional etching media known hitherto, which are based on zinc chloride, were used, the concentrations of zinc, nickel, copper and chromium in the effluent were about 50 to 100 times higher. It is assumed that the low concentrations of heavy metals resulting when the etching medium of this invention is used, are obtained as a result of adsorption of the dissolved heavy metal ions on the aluminum hydroxide precipitated during neutralization.

The etching media of this invention contain, in aqueous solution, 10 to 50 percent by weight of aluminum chloride hexahydrate or an equivalent amount of other aluminum chloride, and 1 to 5 percent by weight of hydrochloric acid. The inorganic reducing agent is peferably hypophosphorous acid, which is used in the form of a water-soluble salt, for example sodium hypophosphate dihydrate (1 to 5 percent by weight). In principle, however, an equivalent amount of other equivalent reducing agent, e.g., sulforous acid or an alkali metal sulphite can also be used.

In principle, suitable viscosity-regulating additives can be any such additive which is compatible with the other components of the etching medium of this invention. Preferably, aqueous solutions or sols of sorbitol, low molecular weight polyvinylpyrrolidone, polyvinyl alcohol, hydroxyethylcellulose or hydroxypropylcellulose are used. The amount of this additive depends of the desired viscosity and can therefore be varied within wide limits. Thus, etching media according to this invention can contain, for example 1 to 25 percent by weight, and preferably 5 to 10 percent by weight, of sorbitol, or equivalent amounts of other viscosity regulator.

The etching rate achievable with the etching medium of this invention can be regulated by the addition of n- or iso-propyl alcohol. Etching media with a low alcohol content permit high etching rates, which advantageously are employed when carrying out corrections with large correction values. If, on the other hand, only a small correction is required, an etching medium with a higher content of n- or iso- propyl alcohol is preferably employed. The amounts of n- or iso- propyl alcohol used are generally 1–10 percent by weight based on the total weight of the etching medium, which is the same basis used for all above cited percentage contents. Other organic solvents equivalent to the mentioned alcohols, of course, can be employed, such as ethylene glycol mono-ethers, e.g. Cellosolves ®.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples all temperatures are set forth uncorrected in degrees Celsius; unless otherwise indicated, all parts and percentages are by weight.

EXAMPLES (a) Preparation of the etching medium 3.2 kg of aluminum chloride hexahydrate, 1.5 kg of aqueous hydrochloric acid (37%), 1.0 kg of aqueous sorbitol solution (60%) and 0.3 kg of sodium hypophosphite dihydrate are dissolved in 4 l of water, with stirring. 500 g of n-propyl alcohol is added to this solution.

(b) Use

The etching medium prepared according to (a) is poured over a chromed gravure cylinder which has a 6 μm thick chromium coating and on which the lands have been protected in the conventional manner by rolling them with a hard etching ink. The entire surface over which the medium is poured is uniformly wetted; after about 30 seconds etching starts at a uniform rate in all wells. Image areas with deep color shades, i.e., with deep wells and a somewhat thinner chromium coating, have been etched through to such an extent after about 4 minutes that the copper surface located beneath the chromium is visible. Image areas with shallower wells and an accordingly somewhat thicker chromium coating are etched through down to the underlying layer of copper after 6 minutes. After adequate etching, the etching medium is rinsed off with water and the hard etching ink is washed off the lands with toluene. After drying, examination under a microscope shows that the lands have not been attacked and that all of the wells which have come into contact with the etching medium have been uniformly enlarged.

When an etching medium which contains 600 g of n-propyl alcohol but is otherwise of identical composition is used, the time taken to etch through at the points with the thinnest chromium coating is 6 minutes. The lands protected with hard printing ink are also not attacked by this etching mixture.

(c) Effluent testing

The etching medium solution rinsed off was neutralized (to pH 7) with dilute sodium hydroxide solution. The metal hydroxides precipitated were filtered off and the filtrate was analyzed to determine the aluminum, copper, nickel and chromium contents. Metal contents of less than 0.1 mg/l were found.

In a parallel experiment with a commercially available etching medium based on zinc chloride, about 20 mg/l of zinc, 2–12 mg/l of copper, 2–12 mg/l of nickel and 2–12 mg/l of chromium were found after the same working up.

Analogous results are obtained with etching mixtures which contain an aqueous solution of polyvinylpyrrolidone or a hydroxyethylcellulose sol in place of the sorbitol solution.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it ot various usages and conditions.

What is claimed is:

1. An etching medium for chromed surfaces, comprising amounts of aluminum chloride, hydrochloric acid and an inorganic reducing agent, effective for etching a chromed surface.

2. An etching medium of claim 1, further comprising an amount of a viscosity regulator effective to regulate the viscosity of the etching medium.

3. An etching medium of claim 1 or 2, further comprising n- or iso- propyl alcohol.

4. An etching medium of claim 1, comprising 10 to 50 percent by weight of aluminum chloride hexahydrate.

5. An etching medium of claim 2, wherein the viscosity regulator is an aqueous sol of a hydroxyethylcellulose or hydroxypropylcellulose, an aqueous sorbitol solution or an aqueous solution of a water-soluble polymer.

6. An etching medium of claim 3, containing 1–10 percent by weight of n- or iso- propyl alcohol.

7. An etching medium of claim 1 or 2, wherein, the reducing agent is hypophosphorous acid or sulfurous acid or a water-soluble salt thereof.

8. A process for correcting a chromed gravure cylinder having lands and wells, comprising, rolling the cylinder with a hard etching ink whereby the lands are protected, treating the cylinder with an etching medium of claim 1 and susequently washing off the etching medium and the hard etching ink.

* * * * *